US011731305B2

(12) United States Patent
Heinzelmann et al.

(10) Patent No.: US 11,731,305 B2
(45) Date of Patent: Aug. 22, 2023

(54) HAND-PORTABLE GARDEN, FORESTRY AND/OR CONSTRUCTION PROCESSING DEVICE AND METHOD FOR OPERATING A HAND-PORTABLE GARDEN, FORESTRY AND/OR CONSTRUCTION PROCESSING DEVICE

(71) Applicant: Andreas Stihl AG & Co. KG, Waiblingen (DE)

(72) Inventors: Georg Heinzelmann, Winnenden (DE); Pirmin Sontheim, Berglen-Rettersburg (DE); Alexander Haas, Spraitbach (DE); Peter Seibold, Fellbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 49 days.

(21) Appl. No.: 17/206,452

(22) Filed: Mar. 19, 2021

(65) Prior Publication Data

US 2021/0291400 A1 Sep. 23, 2021

(30) Foreign Application Priority Data

Mar. 20, 2020 (EP) ..... 20164414

(51) Int. Cl.
*B27B 17/08* (2006.01)

(52) U.S. Cl.
CPC ..... *B27B 17/08* (2013.01)

(58) Field of Classification Search
None
See application file for complete search history.

(56) References Cited

U.S. PATENT DOCUMENTS 8,796,964 B2 8/2014 Dietl et al.
2012/0273242 A1 11/2012 Eshleman et al.
(Continued)

FOREIGN PATENT DOCUMENTS

DE 10 2012 214 975 A1 2/2014
DE 10 2016 121 029 A1 5/2017
(Continued)

OTHER PUBLICATIONS

Cover page of EP 3 077 160 A1 published Oct. 12, 2016 (one (1) page).
(Continued)

*Primary Examiner* — Hwei-Siu C Payer
(74) *Attorney, Agent, or Firm* — Crowell & Moring LLP

(57) ABSTRACT

A hand-portable garden, forestry and/or construction processing device has a cutting tool, an electric drive motor, a motor operating element, and a control device. The cutting tool is designed for cutting through work. The drive motor is designed for driving the cutting tool. The motor operating element is user-adjustable over an adjustment range from a minimum setting to a maximum setting. The control device is designed for controlling a target speed of the drive motor in accordance with a setting of the motor operating element in at least one first operating mode and one second operating mode. In the first operating mode, the target speed increases over at least one segment from a minimum of 0.5 times the adjustment range as the setting increases, wherein the increase changes over the segment by a maximum of 60%. In the second operating mode, the target speed is a minimum of 0.9 times a maximum target speed of the second operating mode as the setting increases from a maximum of 50% of the adjustment range.

17 Claims, 5 Drawing Sheets

(56) References Cited

U.S. PATENT DOCUMENTS

| | | | | |
|---|---|---|---|---|
| 2015/0229256 | A1 | 8/2015 | Forstner et al. | |
| 2016/0279776 | A1 | 9/2016 | Wirnitzer et al. | |
| 2017/0133965 | A1 | 5/2017 | Ichikawa et al. | |
| 2018/0048252 | A1 | 2/2018 | Yabuguchi et al. | |
| 2018/0092298 | A1 | 4/2018 | Takahashi et al. | |
| 2019/0115772 | A1 | 4/2019 | Takeda et al. | |
| 2021/0251151 | A1* | 8/2021 | Leufen | G05B 15/02 |
| 2021/0291400 | A1* | 9/2021 | Heinzelmann | B27B 17/08 |

FOREIGN PATENT DOCUMENTS

| | | | |
|---|---|---|---|
| DE | 10 2017 118 216 | A1 | 2/2018 |
| DE | 10 2017 009 210 | A1 | 4/2018 |
| DE | 10 2018 122 837 | A1 * | 3/2019 |
| DE | 10 2018 125 808 | A1 | 4/2019 |
| EP | 3 864 956 | A1 * | 8/2021 |
| EP | 3 881 992 | A1 * | 9/2021 |
| WO | WO 2015/082169 | A1 | 6/2015 |

OTHER PUBLICATIONS

German-language European Search Report issued in European Application No. 20164414.3 dated Oct. 16, 2020 with partial English translation (nine (9) pages).

* cited by examiner

HAND-PORTABLE GARDEN, FORESTRY AND/OR CONSTRUCTION PROCESSING DEVICE AND METHOD FOR OPERATING A HAND-PORTABLE GARDEN, FORESTRY AND/OR CONSTRUCTION PROCESSING DEVICE

CROSS REFERENCE TO RELATED APPLICATION

This application claims priority under 35 U.S.C. § 119 from European Patent Application No. 20164414.3, filed Mar. 20, 2020, the entire disclosure of which is herein expressly incorporated by reference.

BACKGROUND AND SUMMARY OF THE INVENTION

The invention relates to a hand-portable garden, forestry and/or construction processing device and to a method for operating a hand-portable garden, forestry and/or construction processing device of this kind.

The problem addressed by the invention is that of providing a hand-portable garden, forestry and/or construction processing device and/or a method for operating a hand-portable garden, forestry and/or construction processing device of this kind, which, in particular in each case, has improved characteristics, in particular being user-friendly.

The invention solves this problem by providing a hand-portable garden, forestry and/or construction processing device and/or a method in accordance with the independent claims. Advantageous developments of the invention are described in the dependent claims.

The hand-portable garden, forestry and/or construction processing device according to the invention comprises or has a, in particular movable, in particular rotationally movable, cutting tool, an electric drive motor, a motor operating element, and a, in particular electric, control device, in particular a controller device. The cutting tool is designed or configured for cutting through an item to be processed, in particular through an item to be processed to be cut. The drive motor is designed or configured for driving, in particular directly or indirectly driving, or moving, in particular directly or indirectly moving, the cutting tool. The motor operating element is, in particular, designed or configured to be user-adjustable, in particular user-movable, over an adjustment range, in particular an adjustment travel, from a minimum setting to a maximum setting, in particular a maximum setting different from the minimum setting. The control device is designed or configured for control, in particular automatic control, in particular closed-loop control, of a target speed, in particular of a value of the target speed, of the drive motor in accordance with a setting, in particular a value of the setting, of the motor operating element in or according to at least one first operating mode and one second operating mode, in particular a second operating mode different from the first operating mode. In the first operating mode, the target speed, in particular the value of the target speed, increases over at least one segment from a minimum of 0.5 times, in particular a minimum of 0.6 times, in particular a minimum of 0.7 times, in particular a minimum of 0.8 times, in particular 0.9 times, the adjustment range as the setting increases, in particular as the value of the setting increases. The increase, in particular a value of the increase, changes over the segment by a maximum of 60 percent (%), in particular by a maximum of 50%, in particular by a maximum of 40%, in particular by a maximum of 30%, in particular by a maximum of 20%, in particular by a maximum of 10%, in particular does not change. In the second operating mode, the target speed, in particular the value of the target speed, is a minimum of 0.9 times a maximum target speed, in particular a value of the maximum target speed, of the second operating mode as the setting increases, in particular as the value of the setting increases, from a maximum of 50% or half, in particular a maximum of 40%, in particular a maximum of 30%, of the adjustment range, in particular of the segment, in particular up to an end of the adjustment range.

This, in particular the first operating mode, enables sensitive or delicate proportioning of the target speed, in particular by means of setting, in particular adjusting, the motor operating element, in particular by a user of the garden, forestry and/or construction processing device. This enables sensitive or delicate processing of an item to be processed by means of the garden, forestry and/or construction processing device, in particular the cutting tool. In addition, this, in particular the second operating mode, enables the high target speed to be reached quickly without the motor operating element having to be set a long way, in particular to its maximum setting. This enables an item to be processed to be cut through quickly. Thus, this allows, in particular the first operating mode and the second operating mode allow, multi-functioning of the garden, forestry and/or construction processing device. Thus, the garden, forestry and/or construction processing device is user-friendly.

In particular, a hand-portable garden, forestry and/or construction processing device generally means that the garden, forestry and/or construction processing device can have a mass of at most 50 kilograms (kg), in particular of at most 20 kg, in particular of at most 10 kg, in particular of at most 5 kg, and/or of at least 1 kg, in particular of at least 2 kg.

The item to be processed can be wood, grass, stone or metal.

The drive motor, in particular a rotor of the drive motor, and the cutting tool can be coupled to one another without a clutch, in particular for conjoint rotation. In addition or as an alternative, the garden, forestry and/or construction processing device need not or may not have a transmission, in particular a selectable transmission, between, in particular functionally between, the drive motor and the cutting tool.

In particular, the motor operating element can be designed, in particular, as a pressure operating element, in particular a pushbutton. In addition or as an alternative, the motor operating element can have at least three, in particular at least five, different settings. In particular, the motor operating element can be continuously user-adjustable.

The segment can start from a start setting of the motor operating element, in particular a start setting different from the minimum setting, and/or can end with the maximum setting. In addition or as an alternative, the increase can start with zero or a minimum target speed, in particular a minimum target speed different from zero, in particular of the first operating mode, and/or can end with a maximum target speed of the first operating mode. In particular, the maximum target speed can be a minimum of 2 times the minimum target speed. As a further addition or alternative, the increase can change by a maximum of 60% between a start of the segment and an end of the segment. For example: start of the segment 100 in arbitrary units (abbreviation: a.u.) and end of the segment 40 a.u. or 160 a.u., or end of the segment 100 a.u. and start of the segment 40 a.u. or 160 a.u.

In the first operating mode, the target speed can decrease over at least the segment as the setting decreases. The decrease can change over the segment by a maximum of 60%, in particular by a maximum of 50%, in particular by a maximum of 40%, in particular by a maximum of 30%, in particular by a maximum of 20%, in particular by a maximum of 10%, in particular may not change.

In the second operating mode, the target speed can be a minimum of 0.9 times the maximum target speed of the second operating mode as the setting decreases up to a maximum of 50%, in particular a maximum of 40%, in particular a maximum of 30%, of the adjustment range, in particular from one end of the adjustment range.

In other words, in the first operating mode and/or in the second operating mode, the target speed can be, in particular, assigned, to the setting both as the setting decreases and as the setting increases. Only the decrease can end with a stop or off setting of the motor operating element, in particular a stop or off setting different from the start setting and/or a stop or off setting identical with the minimum setting, and/or the decrease can end with a lower minimum target speed, in particular zero.

The first operating mode, in particular assignment of the target speed to the setting in the first operating mode, and/or the second operating mode, in particular assignment of the target speed to the setting in the second operating mode, can, in particular in each case, be constant, in particular constant over time, in particular until a switchover is made to a different operating mode. In addition or as an alternative, at least the first operating mode and the second operating mode can be set in a fixed way or predetermined at the factory or such that they cannot be specified by the user.

The target speed can be reached in a load-free state of the garden, forestry and/or construction processing device, in particular of the drive motor.

The control device can be designed for controlling a torque generated by the drive motor in order to achieve the target speed. In addition or as an alternative, the control device can be designed for controlling the target speed at a point in time either in the first operating mode or the second operating mode. As a further addition or alternative, the control device can be designed for controlling the target speed in the first and the second operating mode and at least one third operating mode. As a further addition or alternative, the control device can be designed for switching over between at least the first operating mode and the second operating mode. As a further addition or alternative, the control device can have a microcontroller.

In a development of the invention, the garden, forestry and/or construction processing device is a saw, in particular a chainsaw, a brushcutter or a cut-off grinder. In addition or as an alternative, the cutting tool is a sawing tool, in particular a saw chain or a saw blade, or a cutting blade. Particularly in the case of the saw, in particular the chainsaw, and/or of the brushcutter and/or of the sawing tool, in particular of the saw chain or of the saw blade, this, in particular the first operating mode, makes it easy to fell and/or easy to cut to length a tree trunk. In addition, this, in particular the second operating mode, makes it easy to remove branches or delimb and/or easy to manage young stock. As a further addition or alternative, this, in particular the second operating mode, allows an initial cut to be made in the item to be processed in the case of the cut-off grinder. In addition, this, in particular the first operating mode, enables the item to be processed to be cut through at a time following on from the initial cut.

In a development of the invention, in the first operating mode, the target speed, in particular the value of the target speed, increases linearly over at least the segment as the setting increases, in particular as the value of the setting increases. Alternatively, in the first operating mode, the increase lessens or decreases over the segment as the setting increases, in particular as the value of the setting increases. This allows particularly sensitive or delicate proportioning of the target speed.

In a development of the invention, in the second operating mode, the target speed, in particular the value of the target speed, increases, in particular from a minimum target speed, in particular a value of the minimum target speed, in particular a minimum target speed different from zero, in particular of the second operating mode, up to a minimum of 0.9 times the maximum target speed, in particular the value of the maximum target speed, of the second operating mode, in particular linearly, in particular as the setting increases, in particular as the value of the setting increases, in particular from a start setting of the motor operating element, in particular from a start setting different from the minimum setting and/or the maximum setting, up to a maximum of 50%, in particular a maximum of 40%, in particular a maximum of 30%, of the adjustment range. More particularly the increase, in particular a value of the increase, changes, in particular from the start setting, up to a maximum of 50%, in particular a maximum of 40%, in particular a maximum of 30%, of the adjustment range, by a maximum of 60%, in particular by a maximum of 50%, in particular by a maximum of 40%, in particular by a maximum of 30%, in particular by a maximum of 20%, in particular by a maximum of 10%, in particular not at all, and/or lessens or abates, as the setting increases, in particular as the value of the setting increases, in particular from the start setting, up to a maximum of 50%, in particular a maximum of 40%, in particular a maximum of 30%, of the adjustment range. This allows a gentle start and/or somewhat sensitive or delicate proportioning of the target speed in the second operating mode, in particular without the need to switch over to the first operating mode.

In a development of the invention, in the second operating mode, the target speed, in particular the value of the target speed, is the maximum target speed, in particular the value of the maximum target speed, of the second operating mode as the setting increases, in particular as the value of the setting increases, from a maximum of 50%, in particular a maximum of 40%, in particular a maximum of 30%, of the adjustment range, in particular up to the end of the adjustment range.

In addition or as an alternative, the maximum target speed in the second operating mode can be the maximum target speed in all the operating modes.

In a development of the invention, the maximum target speed, in particular the value of the maximum target speed, of the second operating mode is higher than a maximum target speed, in particular a value of the maximum target speed, of the first operating mode. This enables an item to be processed to be cut through particularly quickly, in particular making it especially easy to remove branches and/or especially easy to manage young stock. In particular, the maximum target speed of the second operating mode can be higher than the maximum target speed of the first operating mode by a minimum of 1.1 times and/or a maximum of 5 times, in particular a maximum of 4 times, in particular a maximum of 3 times, in particular a maximum of 2 times.

In a development of the invention, the control device is designed or configured for controlling the target speed, in particular the value of the target speed, to be at least equal, in particular a minimum of 0.9 times, in particular a minimum of 0.8 times, in particular a minimum of 0.7 times, the maximum target speed, in particular the value of the maximum target speed, of the second operating mode by means of field weakening in the drive motor. This allows the possibility that the maximum target speed of the second operating mode is high. In addition or as an alternative, this allows an efficiency-optimized design of the drive motor. In particular, the high target speed and thus a high kinetic energy of the cutting tool may be more important or more relevant in some cases, especially those such as branch removal and/or maintenance of young stock, than a high torque. In the case of a lower target speed, in contrast, a high torque may be important or relevant, in some cases, especially those such as felling and/or cutting to length, particularly for pulling out the cutting tool. In particular, the control device can be designed for controlling the target speed by means of field weakening in the drive motor in at least the second operating mode. In addition or as an alternative, the control device can be designed for controlling a lower target speed by means of MMPA in at least the first operating mode and/or second operating mode.

As an alternative, the control device can be designed for controlling the target speed by means of block commutation in at least the first operating mode and/or the second operating mode.

In a development of the invention, the control device is designed or configured for controlling up to a minimum of 0.9 times, in particular to, the maximum target speed, in particular the value of the maximum target speed, of the second operating mode with a minimum of 0.8 times, in particular and/or at the maximum, a maximum output power, in particular a value of the maximum output power, of the drive motor. This allows a good efficiency of the drive motor, in particular despite the field weakening, where present.

In a development of the invention, the drive motor is a brushless DC motor or a permanent magnet synchronous motor or an asynchronous motor. In addition or as an alternative, the control device is designed or configured for FOC control (Field-Oriented Control) or DTC control (Direct Torque Control). This enables the target speed to be controlled by means of field weakening, at least in the second operating mode.

In a development of the invention, the garden, forestry and/or construction processing device comprises or has an electric adjusting device. The motor operating element is designed or configured for setting an electric variable, in particular a value of the variable, of the adjusting device. The control device is designed or configured for controlling the target speed, in particular the value of the target speed, in accordance with the variable, in particular the value of the variable. This allows control of the target speed in accordance with the setting. In particular, the adjusting device can have a potentiometer or a Hall-effect sensor, and/or the variable can be an electric resistance or a Hall voltage.

In a development of the invention, in the first operating mode, the target speed, in particular the value of the target speed, decreases, in particular linearly, when the motor operating element is returned to its minimum setting, or triggered by this return, from the target speed last controlled in the time before the return, in particular the maximum target speed, to zero over a run-down or braking time range of the first operating mode. The decrease, in particular a value of the decrease, changes by a maximum of 60%, in particular by a maximum of 50%, in particular by a maximum of 40%, in particular by a maximum of 30%, in particular by a maximum of 20%, in particular by a maximum of 10%, in particular does not change, over a minimum of 0.9 times the run-down time range, in particular over the run-down time range.

This allows particularly sensitive or delicate proportioning of the target speed.

In addition or as an alternative, in the second operating mode, the target speed, in particular the value of the target speed, decreases, when the motor operating element is returned to its minimum setting, or triggered by this return, from the target speed last controlled in the time before the return, in particular the maximum target speed, to zero over a run-down or braking time range of the second operating mode, said target speed decreasing in its early half, in particular of the run-down time range, by a maximum of 0.5 times, in particular a maximum of 0.25 times, as much as it decreases in its late half, in particular of the run-down time range, in particular does not decrease.

This enables the target speed to remain for a relatively long period in the region of the target speed last controlled in the time before the return. Thus, this enables the, in particular high, target speed, in particular the maximum target speed, to be reached particularly quickly when the motor operating element is set again.

In particular, the run-down time range of the first operating mode can be of the same temporal length as the run-down time range of the second operating mode. In addition or as an alternative, the length of the run-down time range of the first operating mode and/or the length of the run-down time range of the second operating mode can, in particular in each case, be a maximum of 5 seconds (s), in particular a maximum of 2 s, and/or a minimum of 0.1 s, in particular a minimum of 0.2 s, in particular a minimum of 0.5 s. As a further addition or alternative, the decrease can change by a maximum of 60% between a start of the run-down time range of the first operating mode and an end of the run-down time range of the first operating mode. For example: start of run-down time range 100 a.u. and end of run-down time range 40 a.u. or 160 a.u., or end of run-down time range 100 a.u. and start of run-down time range 40 a.u. or 160 a.u. As a further addition or alternative, it is possible, in the first operating mode and/or the second operating mode, for the decrease to be accomplished, in particular by means of the control device, by coasting, in particular without active braking, energy recovery or regenerative braking, in particular at a later time than the coasting process, and short-circuit braking, in particular at a later time than the energy recovery process. In particular, these three steps can take place or be carried out over different lengths of time or with different weighting in the first operating mode and in the second operating mode.

In a development of the invention, the garden, forestry and/or construction processing device comprises or has a motor operating element return element. The motor operating element return element is designed or configured for applying force to the motor operating element to return it to its minimum setting. This enables the target speed to decrease, in particular automatically, when the set motor operating element is eased, in particular released. In particular, the motor operating element return element can have, in particular can be, a spring. In addition or as an alternative, the potentiometer, where present, can be, in particular can be designed to be, self-returning.

In a development of the invention, the garden, forestry and/or construction processing device comprises or has a user-operable, in particular user-movable, switchover operating element. The control device is designed or configured for switching over between at least the first operating mode and the second operating mode, this being triggered by an operation of the switchover operating element. This enables the garden, forestry and/or construction processing device to be set easily for the respective task, in particular by the user. In particular, the switchover operating element can be different from the motor operating element. In addition or as an alternative, the switchover operating element can be, in particular can be designed, in particular, as a pressure operating element, in particular a pushbutton. As a further addition or alternative, the switchover operating element can be, in particular can be designed to be, self-returning.

In a development of the invention, the garden, forestry and/or construction processing device comprises or has an, in particular electric, output device, in particular a display. The output device is designed or configured to output, in particular display, in particular automatically, user-perceivable information about control in or according to at least the first operating mode or the second operating mode. This allows feedback for the user. In particular, the display can have, in particular can be, at least one LED.

The method according to the invention is designed or configured for operating, in particularly automatically operating, a, in particular the, hand-portable garden, forestry and/or construction processing device of the kind described above. The method comprises or has the following step: controlling, in particularly automatically controlling, the target speed of the drive motor in accordance with the setting of the motor operating element in at least, in particular either, the first operating mode or the second operating mode by means of the control device.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
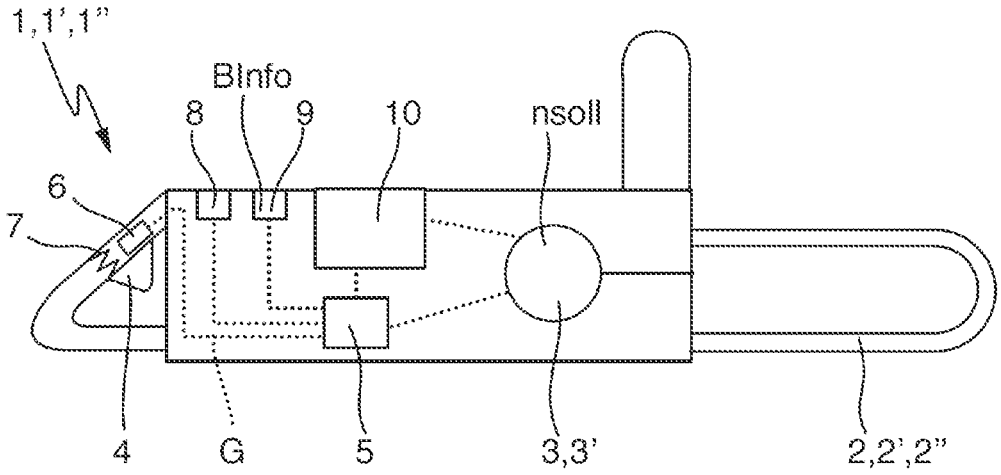
FIG. 1 shows schematically a hand-portable garden, forestry and/or construction processing device according to an embodiment of the invention and a method according to an embodiment of the invention for operating the garden, forestry and/or construction processing device.
Figure 2:
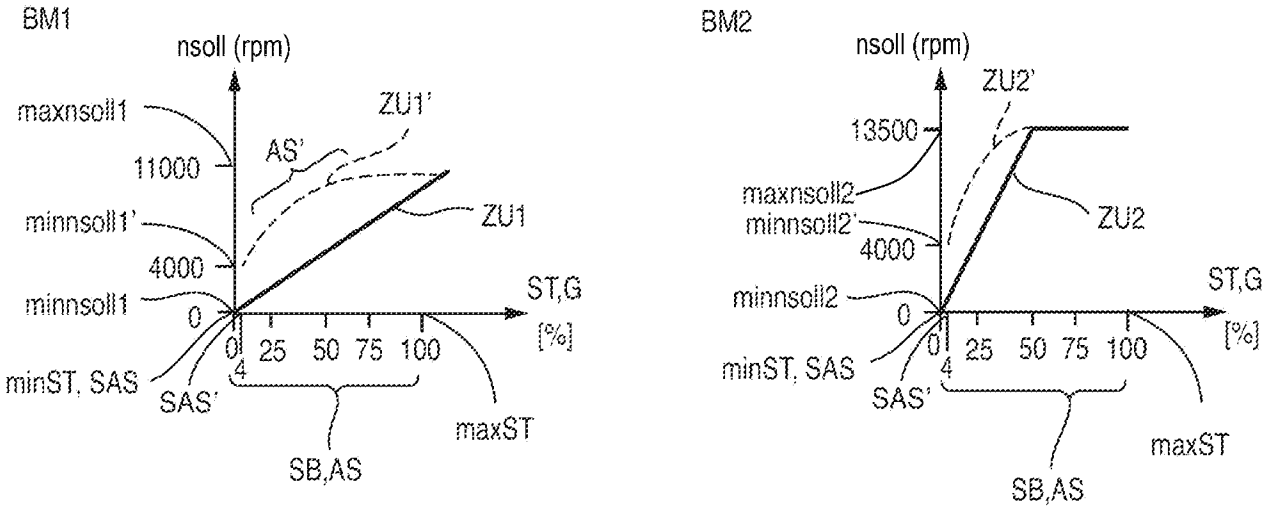
FIG. 2 shows a graph of a target speed of a drive motor against a setting of a motor operating element of the garden, forestry and/or construction processing device in FIG. 1 in a first operating mode and a graph of the target speed against the setting in a second operating mode.

FIG. 1 shows a hand-portable garden, forestry and/or construction processing device 1 and a method for operating the garden, forestry and/or construction processing device 1. The garden, forestry and/or construction processing device 1 has a cutting tool 2, an electric drive motor 3, a motor operating element 4, and a control device 5. The cutting tool 2 is designed for cutting through an item to be processed, in particular it cuts through an item to be processed. The drive motor 3 is designed to drive, in particular drives, the cutting tool 2. The motor operating element 4 is user-adjustable, in particular is adjusted, over an adjustment range (SB) from a minimum setting (minST) to a maximum setting (maxST), as shown in FIG. 2. The control device 5 is designed for controlling, in particular controls, a target speed (nsoll) of the drive motor 3 in accordance with a setting (ST) of the motor operating element 4 in at least one first operating mode (BM1), as shown on the left in FIG. 2, and one second operating mode (BM2), as shown on the right in FIG. 2. In the first operating mode (BM1), the target speed (nsoll) increases over at least one segment (AS, AS') from a minimum of 0.5 times, in the exemplary embodiment shown by a continuous line on the left in FIG. 2 immediately, the adjustment range (SB) as the setting (ST) increases. The increase (ZU1, ZU1') changes over the segment (AS, AS') by a maximum of 60%. In the second operating mode (BM2), the target speed (nsoll) is a minimum of 0.9 times a maximum target speed (maxnsoll2) of the second operating mode (BM2) as the setting (ST) increases from a maximum of 50% of the adjustment range (SB), in particular of the segment (AS, AS').

The method has the following step: controlling the target speed (nsoll) of the drive motor 3 in accordance with the setting (ST) of the motor operating element 4 in at least the first operating mode (BM1) or the second operating mode (BM2) by means of the control device 5.

In the exemplary embodiment shown by a continuous line on the left in FIG. 2, the segment (AS) starts from the minimum setting (minST) and ends with the maximum setting (maxST). In alternative exemplary embodiments, the segment can start from a start setting of the motor operating element different from the minimum setting. In the exemplary embodiment shown by a dashed line on the left in FIG. 2, the increase (ZU1') starts from a 4% start setting (SAS') and ends with a 75% setting.

In particular, the minimum setting is (minST) 0%. In addition, the maximum setting is (maxST) 100%.

In the exemplary embodiment shown by a continuous line on the left in FIG. 2, the increase (ZU1) additionally begins with a minimum target speed (minnsoll1) equal to zero and ends with a maximum target speed (maxnsoll1) of the first operating mode (BM1). In alternative exemplary embodiments, the increase can start with a minimum target speed different from zero. In particular, the increase (ZU1') in the exemplary embodiment shown by a dashed line on the left in FIG. 2 starts with a minimum target speed (minnsoll1') of 4000 revolutions per minute (rpm).

As a further addition, in the exemplary embodiment shown, the garden, forestry and/or construction processing device 1 is a saw 1', in particular a chainsaw 1". In alternative exemplary embodiments, the garden, forestry and/or construction processing device can be a brushcutter or a cut-off grinder.

In addition, in the exemplary embodiment shown, the cutting tool 2 is a sawing tool 2', in particular a saw chain 2". In alternative exemplary embodiments, the cutting tool can be a saw blade or a cutting blade.

In detail, the target speed (nsoll) in the exemplary embodiment shown by a continuous line on the left in FIG. 2 increases linearly over at least the segment (AS) as the setting (ST) increases in the first operating mode (BM1).

As an alternative, the increase (ZU1') in the exemplary embodiment shown by a dashed line on the left in FIG. 2 lessens over the segment (AS') as the setting (ST) increases in the first operating mode (BM1).

Furthermore, in the second operating mode (BM2), the target speed (nsoll) increases, in particular from a start setting (SAS, SAS') of the motor operating element 4, which is the same as the minimum setting (minST) in the exemplary embodiment shown by a continuous line on the right in FIG. 2, up to a maximum of 50% of the adjustment range (BS) as the setting (ST) increases, in particular from a minimum target speed (minnsoll2), (minnsoll2'), equal to zero in the exemplary embodiment shown by a continuous line on the right in FIG. 2, up to a minimum of 0.9 times the maximum target speed (maxnsoll2) of the second operating mode (BM2), increasing linearly in the exemplary embodiment shown by a continuous line on the right in FIG. 2. In particular the increase (ZU2, ZU2') changes by a maximum of 60%, in particular from the start setting (SAS, SAS'), up to a maximum of 50% of the adjustment range (SB), there being no change in the exemplary embodiment shown by a continuous line on the right in FIG. 2, and/or lessens, in particular from the start setting (SAS'), up to a maximum of 50% of the adjustment range (SB) as the setting (ST) increases, in particular in the exemplary embodiment shown by a dashed line on the right in FIG. 2. In alternative exemplary embodiments, the increase can start with a minimum target speed different from zero. In particular, the increase (ZU2') in the exemplary embodiment shown by a dashed line on the right in FIG. 2 starts with a minimum target speed (minnsoll2') of 4000 rpm. In addition or as an alternative, the target speed (nsoll) in the exemplary embodiment shown by a dashed line on the right in FIG. 2 increases from a 4% start setting (SAS') in the second operating mode (BM2).

Moreover, in the second operating mode (BM2), the target speed (nsoll) is the maximum target speed (maxnsoll2) of the second operating mode (BM2) as the setting (ST) increases from a maximum of 50% of the adjustment range (SB).

Furthermore, the maximum target speed maxnsoll2 of the second operating mode (BM2) is higher than the maximum target speed maxnsoll1 of the first operating mode (BM1).

Figure 3:
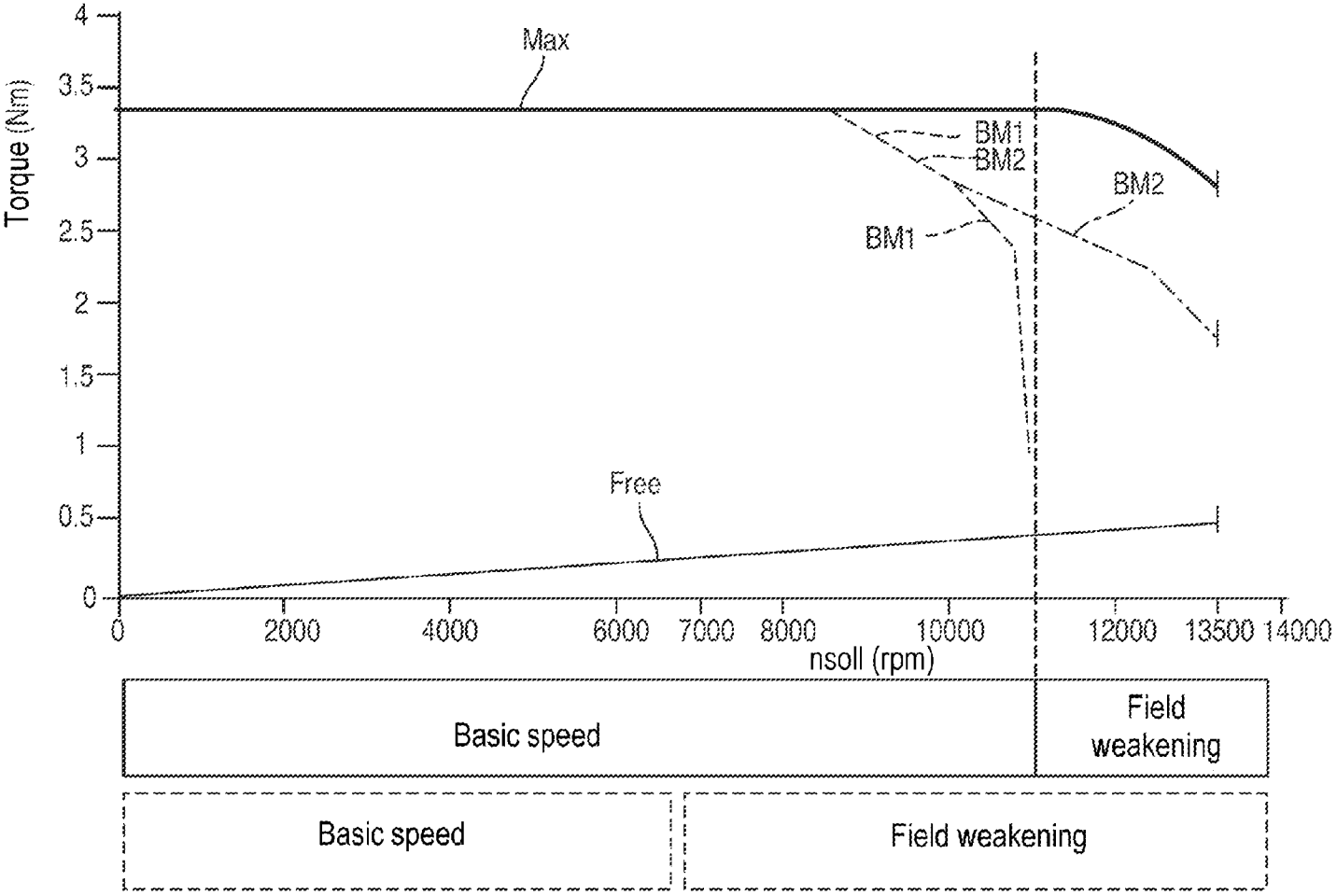
FIG. 3 shows a graph of a torque of the drive motor against the target speed.

Moreover, the control device 5 is designed for controlling, in particular controls, the target speed (nsoll) to be at least equal, in particular a minimum of 0.9 times, the maximum target speed (maxnsoll2) of the second operating mode (BM2) by means of field weakening in the drive motor 3, as shown in FIG. 3.

In the exemplary embodiment shown, the control device 5 is designed for controlling the target speed (nsoll) in the second operating mode (BM2) not by means of field weakening in the drive motor 3. In alternative exemplary embodiments, the control device can be designed for controlling the target speed by means of field weakening in the drive motor in at least the second operating mode. This is shown, in particular, by dashed lines in FIG. 3.

Figure 4:
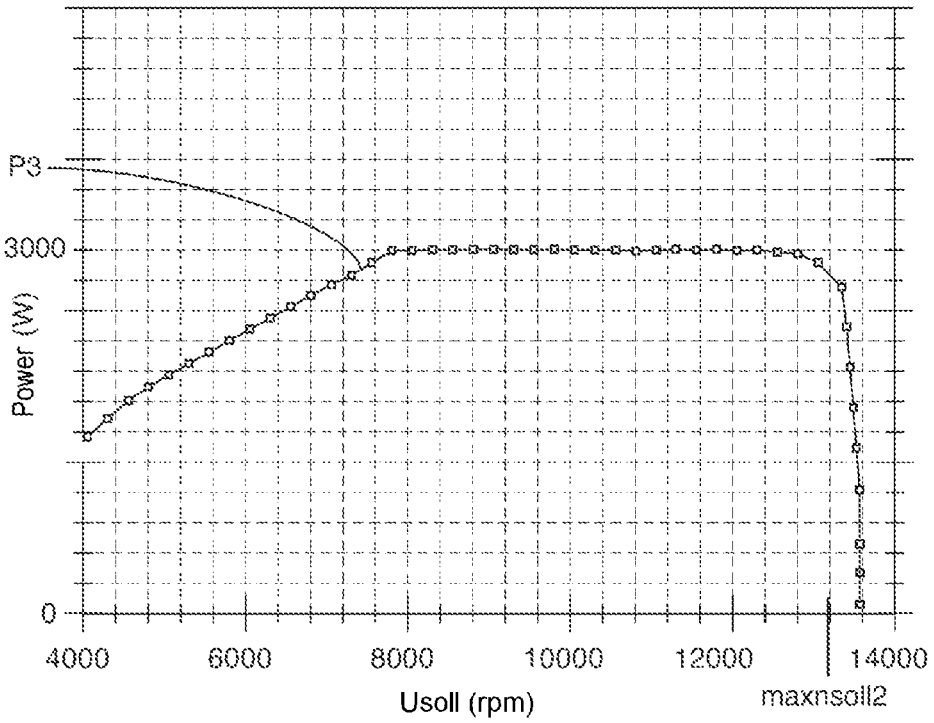
FIG. 4 shows a graph of a maximum output power of the drive motor against the target speed.

Furthermore, the control device 5 is designed for controlling, in particular controls, up to a minimum of 0.9 times the maximum target speed (maxnsoll2) of the second operating mode (BM2) with a minimum of 0.8 times a maximum output power (P3) of the drive motor 3, as shown in FIG. 4.

Moreover, in the exemplary embodiment shown, the drive motor 3 is a brushless DC motor 3', as shown in FIG. 1. In alternative exemplary embodiments, the drive motor can be a permanent magnet synchronous motor or an asynchronous motor.

In addition, the control device 5 is designed for, in particular controls by, FOC control or DTC control.

Furthermore, the garden, forestry and/or construction processing device 1 has an electric adjusting device 6. The motor operating element 4 is designed for adjusting, in particular adjusts, an electric variable G of the adjusting device 6. The control device 5 is designed for controlling, in particular controls, the target speed (nsoll) in accordance with the variable G, as shown in FIG. 2.

Figure 5:
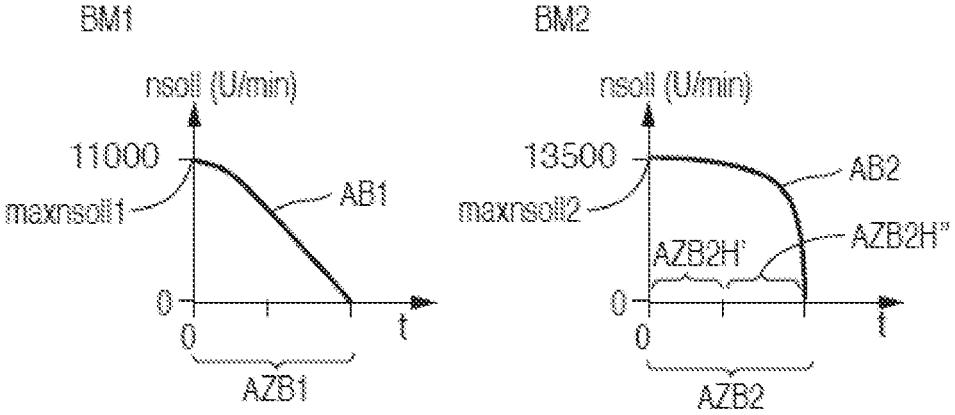
FIG. 5 shows a graph of the target speed against a time in the first operating mode and a graph of the target speed against time in the second operating mode.

Moreover, in the first operating mode (BM1), the target speed (nsoll) decreases, when the motor operating element 4 is returned to its minimum setting (minST), from the target speed last controlled in the time before the return, in particular the maximum target speed (maxnsoll1), to zero over a run-down time range (AZB1) of the first operating mode (BM1), as shown on the left in FIG. 5. The decrease (AB1) changes by a maximum of 60% over a minimum of 0.9 times the run-down time range (AZB1).

In addition, in the second operating mode (BM2), the target speed (nsoll) decreases, when the motor operating element 4 is returned to its minimum setting (minST), from the target speed last controlled in the time before the return, in particular the maximum target speed (maxnsoll2), to zero over a run-down time range (AZB2) of the second operating mode (BM2), said target speed decreasing in its early half (AZB2H') by a maximum of 0.5 times as much as it decreases in its late half (AZB2H"), as shown on the right in FIG. 5.

Furthermore, the garden, forestry and/or construction processing device 1 has a motor operating element return element 7, as shown in FIG. 1. The motor operating element return element 7 is designed for applying force, in particular applies force, to the motor operating element 4 to return it to its minimum setting (minST).

Furthermore, the garden, forestry and/or construction processing device 1 has a user-operable switchover operating element 8. The control device 5 is designed for switching over, in particular switches over, between at least the first operating mode (BM1) and the second operating mode (BM2), this being triggered by an operation of the switchover operating element 8.

Furthermore, the garden, forestry and/or construction processing device 1 has an output device 9. The output device 9 is designed to output, in particular outputs, user-perceivable information (BInfo) about control in at least the first operating mode (BM1) or the second operating mode (BM2).

In the exemplary embodiment shown, the maximum target speed (maxnsoll1) of the first operating mode (BM1) is 11000 rpm. In addition or as an alternative, the maximum target speed (maxnsoll2) of the second operating mode (BM2) is 13500 rpm. In alternative exemplary embodiments, the maximum target speed of the second operating mode can be up to 35000 rpm. As a further addition or alternative, in the first operating mode (BM1) and/or in the second operating mode (BM2), in particular in each case, the, in particular available, maximum output power P3 of the drive motor 3 is 3000 watts (W). As a further addition or alternative, in the first operating mode (BM1) and/or in the second operating mode (BM2), in particular in each case, a freewheel function, in particular for the cutting tool 2, is switched on or activated.

In the exemplary embodiment shown, the control device 5 is furthermore designed for controlling, in particular controls, the target speed (nsoll) in the first operating mode (BM1) and the second operating mode (BM2). In alternative exemplary embodiments, the control device can be designed for controlling, in particular can control, the target speed in the first and the second operating mode and at least one third operating mode. In particular, the third operating mode can be like the first operating mode, with the following difference/s. The maximum target speed of the third operating mode can be lower than the maximum target speed of the first operating mode, in particular 9000 rpm. In addition or as an alternative, it is possible in the third operating mode for the, in particular allowed, maximum output power of the drive motor, in particular and thus a maximum torque generated by the drive motor, to be lower than in the first operating mode, in particular between 2100 W and 2300 W. As a further addition or alternative, the freewheel function can be switched off or deactivated in the third operating mode. As a further addition or alternative, the first operating mode (BM1) can be referred to as an all-round or normal mode. As a further addition or alternative, the second operating mode (BM2) can be referred to as a speed mode. As a further addition or alternative, the third operating mode can be referred to as an eco mode.

In the exemplary embodiment shown, the garden, forestry and/or construction processing device 1, in particular the drive motor 3 and/or the control device 5, are/is furthermore designed for electrical connection, in particular are/is electrically connected, to a rechargeable battery 10. In alternative exemplary embodiments, the garden, forestry and/or construction processing device can additionally or alternatively be designed for electric connection to a cable.

In the exemplary embodiment shown, the cutting tool 2 and the drive motor 3 are furthermore coupled, in particular mechanically, as shown by a continuous line in FIG. 1. Furthermore, the drive motor 3 and the control device 5 are coupled, in particular electrically, as shown by a dotted line in FIG. 1. Moreover, the control device 5 and the potentiometer 6 are coupled, in particular electrically. Furthermore, the potentiometer 6 and the motor operating element 4 are coupled, in particular mechanically. Moreover, the motor operating element 4 and the motor operating element return element 7 are coupled, in particular mechanically. Furthermore, the control device 5 and the switchover operating element 8 are coupled, in particular electrically. Moreover, the control device 5 and the output device 9 are coupled, in particular electrically.

As the exemplary embodiments shown and explained above make clear, the invention makes available an advantageous hand-portable garden, forestry and/or construction processing device and/or an advantageous method for operating a hand-portable garden, forestry and/or construction processing device of this kind, which, in particular in each case, has improved characteristics, in particular is user-friendly.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A hand-portable garden, forestry and/or construction processing device, comprising:

a cutting tool, wherein the cutting tool is designed for cutting through an item to be processed;

an electric drive motor, wherein the drive motor is designed for driving the cutting tool;

a motor operating element, wherein the motor operating element is user-adjustable over an adjustment range from a minimum setting to a maximum setting; and a control device, wherein the control device is designed for controlling a target speed of the drive motor in accordance with a setting of the motor operating element in a first operating mode and a second operating mode, wherein, in the first operating mode, the target speed increases over at least one segment from a minimum of 0.5 times the adjustment range as the setting increases, wherein the target speed increase changes over the segment by a maximum of 60%, and wherein, in the second operating mode, the target speed is a minimum of 0.9 times a maximum target speed of the second operating mode as the setting increases from a maximum of 50% of the adjustment range.

2. The hand-portable garden, forestry and/or construction processing device according to claim 1, wherein the garden, forestry and/or construction processing device is a saw, a chainsaw, a brushcutter, or a cut-off grinder, and/or wherein the cutting tool is a sawing tool, a saw chain or a saw blade or a cutting blade.

3. The hand-portable garden, forestry and/or construction processing device according to claim 1, wherein one of:

(i) in the first operating mode, the target speed increases linearly over the at least one segment as the setting increases, or (ii) in the first operating mode, the target speed increase lessens over the segment as the setting increases.

4. The hand-portable garden, forestry and/or construction processing device according to claim 3, wherein, in the second operating mode, the target speed increases from a minimum target speed up to a minimum of 0.9 times the maximum target speed of the second operating mode, as the setting increases.

5. The hand-portable garden, forestry and/or construction processing device according to claim 4, wherein, in the second operating mode, the target speed increases from a start setting of the motor operating element up to a maximum of 50% of the adjustment range, wherein the target speed increase changes by a maximum of 60% from the start setting up to the maximum of 50% of the adjustment range, and/or lessens as the setting increases from the start setting.

6. The hand-portable garden, forestry and/or construction processing device according to claim 1, wherein in the second operating mode, the target speed is the maximum target speed of the second operating mode as the setting increases from the maximum of 50% of the adjustment range.

7. The hand-portable garden, forestry and/or construction processing device according to claim 1, wherein the maximum target speed of the second operating mode is higher than a maximum target speed of the first operating mode.

8. The hand-portable garden, forestry and/or construction processing device according to claim 1, wherein the control device is designed for controlling the target speed to be the minimum of 0.9 times the maximum target speed of the second operating mode by way of field weakening in the drive motor.

9. The hand-portable garden, forestry and/or construction processing device according to claim 1, wherein the control device is designed for controlling up to the minimum of 0.9 times the maximum target speed of the second operating mode with a minimum of 0.8 times a maximum output power of the drive motor.

10. The hand-portable garden, forestry and/or construction processing device according to claim 1, wherein at least one of:

(i) the drive motor is a brushless DC motor, a permanent magnet synchronous motor or an asynchronous motor, or (ii) the control device is designed for field-oriented control (FOC) control or direct torque control (DTC) control.

11. The hand-portable garden, forestry and/or construction processing device according to claim 1, further comprising:

an electric adjusting device, wherein the motor operating element is designed for setting an electric variable of the electric adjusting device, and wherein the control device is designed for controlling the target speed in accordance with the electric variable.

12. The hand-portable garden, forestry and/or construction processing device according to claim 1, wherein at least one of:

(i) in the first operating mode, the target speed decreases when the motor operating element is returned to its minimum setting from the target speed last controlled in the time before the return, or (ii) in the second operating mode, the target speed decreases when the motor operating element is returned to its minimum setting from the target speed last controlled in the time before the return.

13. The hand-portable garden, forestry and/or construction processing device according to claim 12, wherein at least one of:

(i) in the first operating mode, the target speed decreases from a maximum target speed to zero over a run-down time range of the first operating mode, wherein the target speed decrease changes by a maximum of 60% over a minimum of 0.9 times the run-down time range, or (ii) in the second operating mode, the target speed decreases from the maximum target speed to zero over a run-down time range of the second operating mode, said target speed decreasing in a first half by a maximum of 0.5 times as much as it decreases in a later half.

14. The hand-portable garden, forestry and/or construction processing device according to claim 1, further comprising:

a motor operating element return element, wherein the motor operating element return element is designed for applying force to the motor operating element to return the motor operating element to its minimum setting.

15. The hand-portable garden, forestry and/or construction processing device according to claim 1, further comprising:

a user-operable switchover operating element, wherein the control device is designed for switching over between at least the first operating mode and the second operating mode upon being triggered by an operation of the switchover operating element.

16. The hand-portable garden, forestry and/or construction processing device according to claim 1, further comprising:

an output device, wherein the output device is designed to output user-perceivable information about control in at least the first operating mode or the second operating mode.

17. A method for operating a hand-portable garden, forestry and/or construction processing device comprising:

a cutting tool, wherein the cutting tool is designed for cutting through an item to be processed;

an electric drive motor, wherein the drive motor is designed for driving the cutting tool;

a motor operating element, wherein the motor operating element is user-adjustable over an adjustment range from a minimum setting to a maximum setting; and a control device, wherein the control device is designed for controlling a target speed of the drive motor in accordance with a setting of the motor operating element in a first operating mode and a second operating mode, wherein, in the first operating mode, the target speed increases over at least one segment from a minimum of 0.5 times the adjustment range as the setting increases, wherein the target speed increase changes over the segment by a maximum of 60%, and wherein, in the second operating mode, the target speed is a minimum of 0.9 times a maximum target speed of the second operating mode as the setting increases from a maximum of 50% of the adjustment range, wherein the method comprises the steps of:

controlling the target speed of the drive motor in accordance with the setting of the motor operating element in at least the first operating mode by way of the control device, or controlling the target speed of the drive motor in accordance with the setting of the motor operating element in at least the second operating mode by way of the control device.

* * * * *